US005336987A

United States Patent [19]

Kimura et al.

[11] Patent Number: 5,336,987

[45] Date of Patent: Aug. 9, 1994

[54] VOLTAGE STABILIZING CIRCUIT OF SWITCHING POWER SUPPLY CIRCUIT

[75] Inventors: Yasuhiro Kimura; Tomio Takayama, both of Kawasaki, Japan

[73] Assignee: Fujitsu Limited, Kawasaki, Japan

[21] Appl. No.: 950,644

[22] Filed: Sep. 23, 1992

[30] Foreign Application Priority Data

Sep. 26, 1991 [JP] Japan ..... 3-247400

[51] Int. Cl.[5] ..... G05F 1/56

[52] U.S. Cl. ..... 323/284; 323/351

[58] Field of Search ..... 323/284, 274, 285, 349, 323/351; 363/95, 97, 98

[56] References Cited

U.S. PATENT DOCUMENTS

| | | | |
|---|---|---|---|
| 4,112,764 | 9/1978 | Turner | 73/362 AR |
| 4,857,769 | 8/1989 | Kotera et al. | 307/450 |
| 4,998,177 | 3/1991 | Takizawa et al. | 361/154 |
| 5,175,487 | 12/1992 | Inoue | 323/303 |
| 5,217,296 | 6/1993 | Tanner et al. | 362/183 |

*Primary Examiner*—Steven L. Stephan
*Assistant Examiner*—Adolf Berhane

[57] ABSTRACT

A voltage stabilizing circuit comprising a voltage detecting circuit for detecting a control voltage in response to an output voltage of the voltage stabilizing circuit, and a control circuit for stabilizing, based on the control voltage, the output voltage of the electronic device. To remove the component of a base-emitter voltage from the control voltage, the voltage detecting circuit includes a first series circuit and a second series circuit connected to each other in series. The first series circuit consists of a first resistor and a first transistor connected in series. The second series circuit consists of a second resistor and a second transistor connected in series. The second transistor is connected to function as a diode connection. The first resistor and the second resistor have substantially the same resistances. Thus the control voltage is made to be substantially the same as the output voltage.

7 Claims, 7 Drawing Sheets

VOLTAGE STABILIZING CIRCUIT OF SWITCHING POWER SUPPLY CIRCUIT

BACKGROUND OF THE INVENTION

1. Field of the Invention

The present invention relates to a voltage stabilizing circuit, and more particularly to an output voltage stabilizing circuit of a switching power supply circuit used for, for example an electronic exchange system.

Generally, in various electronic circuits, when a power supply voltage fluctuates, the operating point of a transistor or integrated circuit (CI) is changed so that the originally intended performance cannot be obtained. To prevent this, the output voltage of the power supply circuit is detected by a voltage detecting circuit, and when the detected voltage deviates from a predetermined reference voltage, the power supply circuit is controlled based on the deviation so as to output a stable power supply voltage. The present invention relates to a voltage stabilizing circuit for the above case as an example.

2. Description of a Prior Art

In a conventional voltage stabilizing circuit, a voltage detecting circuit is realized by a mirror circuit including two transistors arranged symmetrically. With the mirror circuit, however, the relation between the output voltage of the voltage stabilizing circuit and the detected voltage detected by the voltage detecting circuit depends on a base-emitter voltage of one of the two transistors. The base-emitter voltage of the transistor has a temperature characteristic such that the base-emitter voltage fluctuates depending on the temperature. Therefore, in the conventional voltage stabilizing circuit, there is a problem in that the accuracy of the detected output voltage is too low because of the fluctuation of the base-emitter voltage which may be caused when the temperature of the environment for the voltage stabilizing circuit is changed or when an abnormal accident occurs at the output side of the power supply circuit to increase the temperature.

It should be noted that such a problem is generated in not only the case of the switching power supply circuit explained above as an example of the application of the voltage stabilizing circuit, but in a series regulator that keeps the output voltage constant by controlling a transistor or a variable resistor, or in a voltage detecting circuit used in various other electronic devices.

SUMMARY OF THE INVENTION

Thus, the present invention has an object to provide a voltage stabilizing circuit for stabilizing the output voltage of an electronic device such as a switching power supply circuit or a switching regulator in which a voltage detecting circuit, for detecting the output voltage of the voltage stabilizing circuit, as a control voltage for the voltage stabilizing circuit can provide the output voltage without being influenced by the component of the base-emitter voltage $B_{BE}$, so that there is no emitter-base voltage $V_{BE}$ in the relation between the output voltage of the voltage stabilizing circuit and a voltage detected by the voltage detecting circuit.

To attain the above object, there is provided, according to the present invention, a voltage stabilizing circuit for stabilizing an output voltage across the output terminals of an electronic device. The circuit comprises a voltage detecting circuit, operatively connected to the output terminals of the electronic device, for detecting a control voltage in response to the output voltage, and a control circuit, operatively connected between the voltage detecting circuit and the electronic device, for stabilizing, based on the control voltage, the output voltage of the electronic device. The voltage detecting circuit includes a first series circuit consisting of a first resistor and a first transistor connected in series. The first transistor has a first electrode connected through the first resistor to one of the output terminal, a base electrode connected to another one of the output terminals, and a second electrode. The voltage detecting circuit further includes a second series circuit consisting of a second resistor and a second transistor connected in series. The second transistor is connected to function as a diode and has a third electrode connected through the second resistor to the second electrode of the first transistor. The control voltage is obtained across the second series circuit. The first resistor and the second resistor have substantially the same resistances, whereby the control voltage is made to be substantially the same as the output voltage.

In the above voltage stabilizing circuit, the first transistor and the second transistor are PNP transistors, and the first electrode of the first transistor is an emitter, the third electrode of the second transistor is an emitter, and the emitter-base voltage of the first transistor is substantially the same as the emitter-base voltage of the second transistor.

Alternatively, the first transistor and the second transistor may be NPN transistors.

In the above voltage stabilizing circuit, the electronic device is a switching power supply circuit, and the control circuit controls, in response to the control voltage, an ON and OFF period of an input voltage applied to the switching power supply circuit.

Instead of the second transistor, a diode may alternatively be employed.

According to the above constitution of the present invention, since the detected control voltage does not include the component of the base-emitter voltage of the transistor, the output voltage is not greatly influenced by temperature.

BRIEF DESCRIPTION OF THE DRAWINGS

The above object and features of the present invention will be understood more clearly from the following description of the preferred embodiments with reference to the accompanying drawings, wherein.

DESCRIPTION OF PREFERRED EMBODIMENTS

Figure 1:
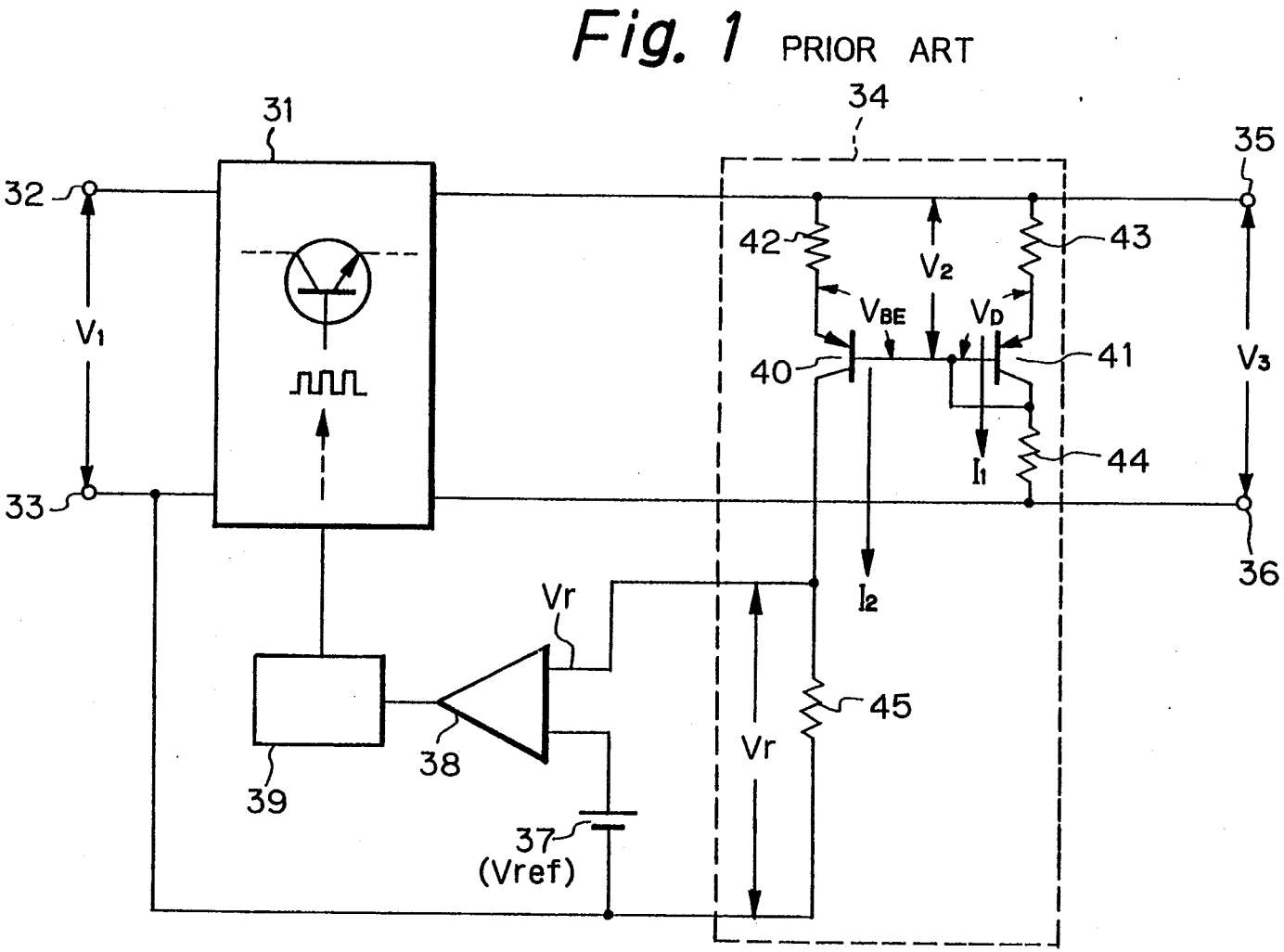
Fig. 1 PRIOR ART
FIG. 1 is a circuit diagram of a conventional voltage stabilizing circuit.

For better understanding of the present invention, a conventional output voltage stabilizing circuit of a switching power supply circuit is first described with reference to FIG. 1. In FIG. 1, 31 is a switching power supply circuit, 32 and 33 are input terminals of the switching power supply circuit, 34 is a voltage detecting circuit, 35 and 36 are output terminals of the switching power supply circuit, 37 is a battery for producing a reference voltage $V_{ref}$ for comparison, 38 is an error amplifier, 39 is a pulse width control comparator for comparing the control voltage detected by the voltage detecting circuit 34 and a reference voltage $V_{ref}$, 40 is a transistor, 41 is a transistor connected to function as a diode, and 42 to 45 are resistors.

Here, the transistors 40 and 41 constitute a mirror circuit in which currents $I_2$ and $I_2$ flowing through the transistors have substantially the same values.

Generally, the ground potential at the output terminal 36 of the switching power supply circuit 31 is not always the same as the ground potential at the input terminal 33 thereof. Therefore, the voltage detecting circuit 34 is necessary to detect a control voltage The voltage $V_{ref}$ is determined with respect to the ground potential at the input terminal 33 of the switching power supply circuit 31, whereas the output voltage $V_2$ is determined with respect to the ground potential at the output terminal 36. The control voltage $V_2$ is used to control the input side of the switching power supply circuit 31.

The voltage detecting circuit 34 is constructed by a mirror circuit comprising the transistors 40 and 41, and the resistor 45 connected to the collector side of the transistor 40. The control voltage $V_2$ across the terminals of the resistor 45 is detected when a collector current $I_2$, which is nearly equal to the emitter current, flows through the transistor 40.

The relation between the detected control voltage across the ends of the resistor 45 and the output voltage $V_3$ of the switching power supply circuit 31 can be determined as follows.

Since the following is established:

$$I_2=(V_3-VD)/(R_{43}+R_{44})$$

$$V_2=I_3R_{43}+V_D$$

$$I_2=(V_2-V_{BE})/R_{42}$$

$$V_r=I_2\cdot R_{45}.$$

Assuming that $V_D=V_{BE}$, then $$V_3=V_4(R_{42}/R_{45})1+R_{44}/R_{43})+V_{BE} \quad (1)$$

The above symbols are defined as follows.

$h_{FE}$: a direct current amplification factor of the transistor 40, $V_2$: a potential difference between the output terminal 35 and the base of the diode-connected transistor 41, $V_D$: a forward voltage of the diode-connected transistor 41, $V_{BE}$: a base-emitter voltage of the transistor 40, $I_1$: a current of the diode-connected transistor 41, $I_2$: a collector current of the transistor 40 nearly equal to the emitter current, and $R_{42}$–$R_{45}$: values of the resistors 42 to 45.

The difference between the detected voltage $V_r$ and the reference voltage $V_{ref}$, is amplified by the error amplifier 38. The output of the error amplifier 38 is supplied to the pulse width control comparator 39. The ratio of the ON period and the OFF period of the switching transistor $Q_1$ is changed depending on the output of the pulse width control comparator 39, whereby the output voltage $V_3$ of the switching power supply circuit 31 is stabilized.

Methods of controlling an ON/OFF state of the transistor $Q_1$ are: pulse number modulation in which one of the ON period and the OFF period of the transistor $Q_1$ is kept constant and the other is changed, and pulse width modulation in which the duty cycle is made constant and the ratio between the ON period and the OFF period of the transistor $Q_1$ (the duty ratio of the ON/-OFF control pulse signal) is changed.

In the conventional equation (1) representing the relation between the output voltage $V_3$ and the detected voltage $V_r$, there is a component of the base-emitter voltage $V_{BE}$. The base-emitter voltage $B_{BE}$ of the transistor 40 has a temperature characteristic in which the base-emitter voltage of the transistor 40 changes depending on the temperature. Therefore, there is a problem in that the accuracy of the detection of output voltage is lowered depending on the temperature fluctuation caused by a change of the operating environment or an abnormality in the output side of the power supply circuit.

It should be noted that such a problem is generated in not only the case of the switching power supply circuit explained above as an example of the application of the voltage stabilizing circuit, but also in a series regulator for keeping the output voltage constant by controlling a transistor or a variable resistor, or in a voltage stabilizing circuit used in various other electronic devices.

Thus, the present invention has an object to provide a voltage stabilizing circuit for stabilizing an output voltage of an electronic device in which a voltage detecting circuit has a special construction for cancelling the component of the base-emitter voltage $V_{BE}$ in the related equation between the output voltage $V_3$, which is to be detected, and the control voltage $V_r$, so that a predetermined accuracy with respect to the output voltage can be kept even when a temperature fluctuation occurs.

Embodiments of the present invention will be described in the following.

Figure 2:
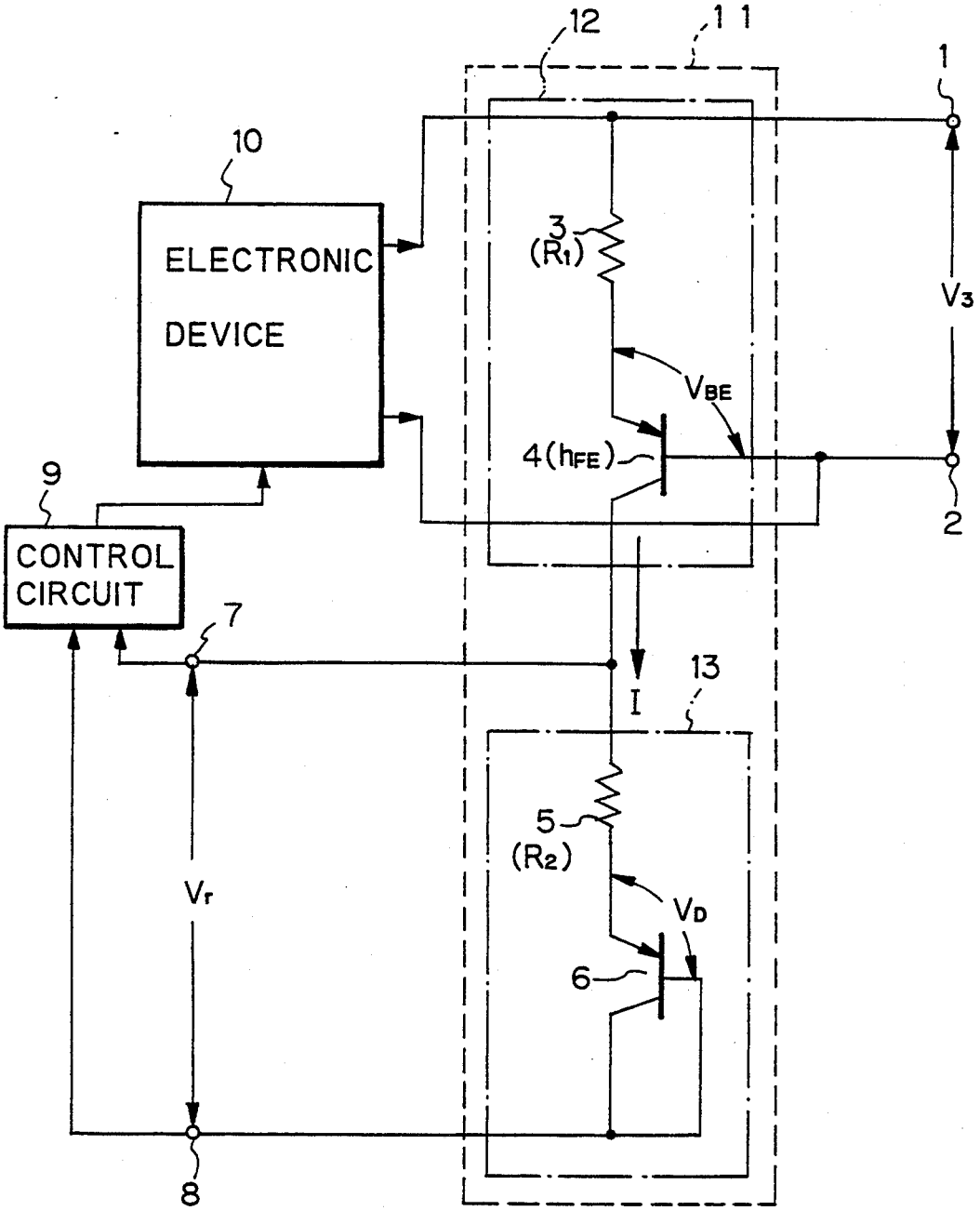
FIG. 2 is a circuit diagram of a voltage stabilizing circuit according to an embodiment of the present invention.

FIG. 2 is a circuit diagram of a voltage stabilizing circuit according to an embodiment of the present invention. In FIG. 2, the voltage stabilizing circuit includes an electronic device 10 for generating an output voltage $V_3$ which is applied across output terminals 1 and 2, a voltage detecting circuit 11 for detecting a control voltage $V_r$, and a control circuit 9 for controlling the electronic device 10 based on the control voltage $V_r$. To the output terminals 1 and 2, a load (not shown) is connected. The voltage detecting circuit 11 includes a first series circuit 12 and a second series circuit 13. The first series circuit 12 includes a first resistor 3 and a first PNP transistor 4 connected in series. The second series circuit 13 includes a second resistor 5, and a second PNP transistor 6 connected in series. The first series circuit 12 and the second series circuit 13 are connected to each other in series. Namely, the collector of the first PNP transistor 4 is connected through the second resistor 5 to the emitter of the second PNP transistor 6. The first resistor 3 is connected between the output terminal 1 and the emitter of the PNP transistor 4. The base of the first PNP transistor 4 is connected to the output terminal 2. The second resistor 5 is connected between the collector of the first PNP transistor 4 and the emitter of the second PNP transistor 6. The second PNP transistor 6 is connected to function as a diode. Namely, the base and the collector of the second PNP transistor 6 are connected together. The control voltage $V_r$ is detected across the ends of the second series circuit 13. Namely, the emitter of the second transistor 6 is connected through the second resistor 5 to a first control terminal 7, and the collector of the second transistor 6 is connected to a second control terminal 8. The control voltage $V_r$ is detected between the first and the second control terminals 7 and 8.

The control voltage $V_r$ is applied to the control circuit 9. In response to the control voltage $V_r$, the control circuit 9 controls the electronic device 10 so that the output voltage $V_3$ is stabilized.

Here, instead of the PNP transistors 4 and 6, PNP transistors may alternatively be employed. Further, instead of the PNP transistor 6, a conventional diode may alternatively be employed. Further, instead of the second series circuit 13, the emitter of the second PNP transistor 6 may be directly connected to the collector of the first transistor 4. In this case, the base and the collector of the second PNP transistor 6 may be connected through the second resistor 5 to the second control terminal 8.

In the voltage stabilizing circuit shown in FIG. 2, the equation showing the relationship between the detected control voltage $V_r$ and the output voltage $V_3$ is as follows.

Since $1/h_{FE}=0$, the following is established.

$$I=(V_3-V_D)/R_1$$

$$V_r=I\cdot R_2+V_D$$

Assuming that $V_D=V_{BE}$, then $$V_3=(R_1/R_2)V_R+V_{RE}(1-R_1/R_2) \quad (2)$$

can be derived.

The above symbols are defined as follows:

$h_{FE}$: a direct current amplification factor of the first PNP transistor 4, $R_1$: the resistance of the first resistor 3

$R_2$: the resistance of the second resistor 5

$V_D$: a forward voltage of the second PNP transistor 6 in a diode connection, $V_{BE}$: a base-emitter voltage of the first PNP transistor 4, and I: a current flowing through the PNP transistors 4 and 6.

Namely, the equation representing the relation between the detected control voltage $V_r$ and the output voltage $V_3$ is expressed by the equation (2), in which, by making the values of the $R_1$ and $R_2$ substantially the same, the component of the base-emitter voltage $V_{BE}$, which changes depending on the temperature while the transistor is being used, can be omitted. The equation (2) thus becomes:

$$V_3=V_r$$

Accordingly, even when the base-emitter voltage of the transistor 4 is changed depending on a change of the temperature of the environment in which the transistor 4 is used, the detected control voltage $V_r$ is substantially the same as the output voltage without being influenced by the change of the temperature.

Figure 3:
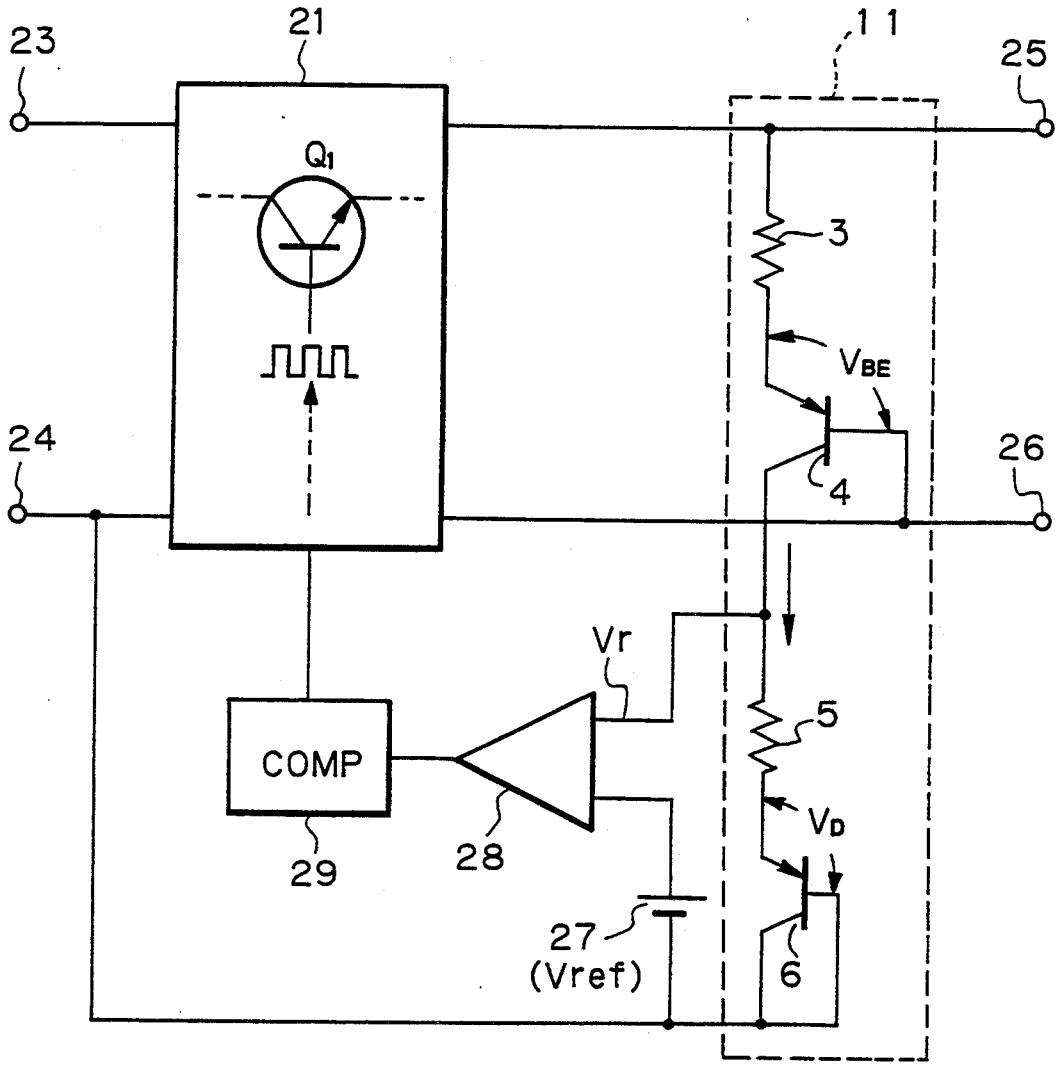
FIG. 3 is a circuit diagram of a voltage stabilizing circuit for stabilizing an output voltage of a switching power supply circuit, according to another embodiment of the present invention.

FIG. 3 is an embodiment in which the voltage stabilizing circuit of the present invention is applied to a switching power supply circuit, wherein 21 is a switching power supply circuit, 11 is the voltage detecting circuit shown in FIG. 2, 23 and 24 are input terminals of the switching power supply circuit 21, 25 and 26 are output terminals of the switching power supply circuit 21, 27 is a battery for producing a comparison reference voltage Vref, 28 is an error amplifier, and 29 is a pulse width control comparator. The switching power supply circuit 21 is an example of the electronic device 10 shown in FIG. 2. The battery 28 and the pulse width control comparator 29 constitute an example of the control circuit 9 shown in FIG. 2.

Here, the comparison reference voltage Vref in FIG. 3, the error amplifier 28, and the pulse width control comparator 29 have the same functions as the comparison reference voltage Vref in FIG. 1, the error amplifier 38, and the pulse width control comparator 39 in the conventional voltage stabilizing circuit shown in FIG. 1. The ON/OFF control of the switching power supply circuit 21 is the same as the switching power supply circuit 31 shown in FIG. 1.

Figure 4:
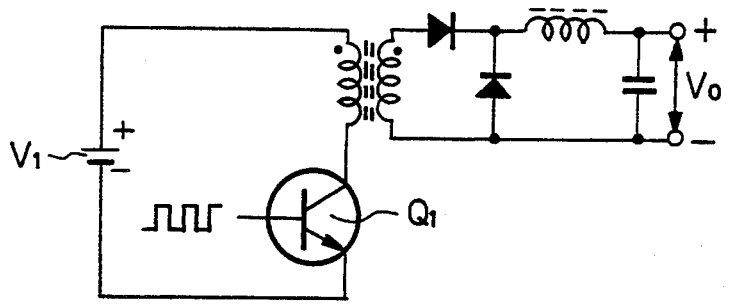
Fig. 4 PRIOR ART
FIG. 4 to FIG. 7 are circuit diagrams of conventional switching power supply circuits.
Figure 5:
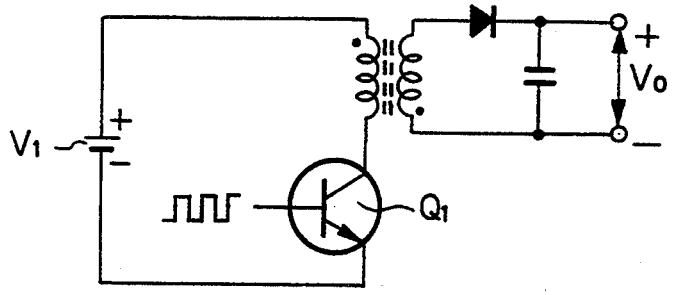
Fig. 5 PRIOR ART
Figure 6:
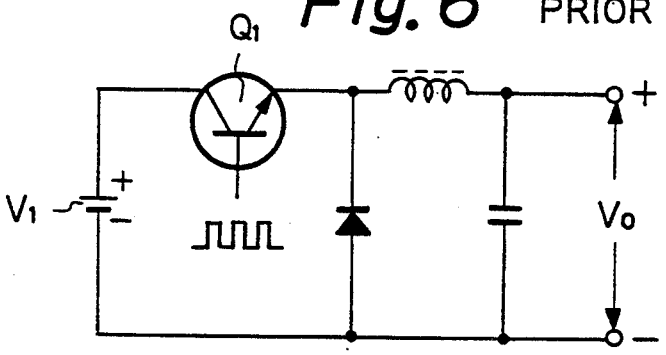
Fig. 6 PRIOR ART
Figure 7:
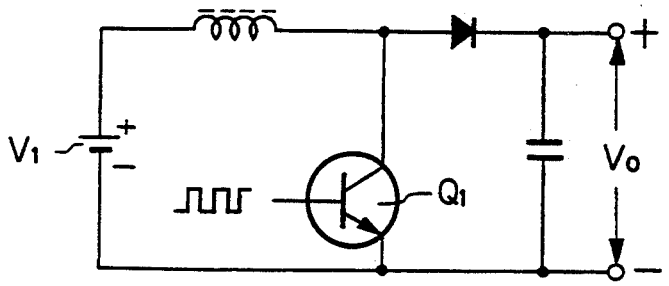
Fig. 7 PRIOR ART

As the switching power supply circuit 21, there is a forward type as shown in FIG. 4 or a fly-back type as shown in FIG. 5, in which an input and an output are isolated from each other, and a step down type as shown in FIG. 6 or a step up type as shown in FIG. 7, in which an input and an output are not isolated from each other. In any case, by controlling a transistor $Q_1$ to be turned ON or OFF, an input voltage $V_1$ is converted into an output voltage $V_0$.

Referring back to FIG. 3, the difference between the detected voltage $V_r$ and the reference voltage$_{ref}$ is amplified by the error amplifier 28. The output of the error amplifier 28 is supplied to the pulse width control comparator 29. The ratio of the ON period and the OFF period of the switching transistor $Q_1$ is changed depending on the output of the pulse width control comparator 29, whereby the output voltage $V_3$ of the switching power supply circuit 31 is stabilized.

Methods of controlling an ON/OFF state of the transistor $Q_1$ are: a pulse number modulation in which one of the ON period and the OFF period of the transistor $Q_1$ is kept constant and the other is changed, and a pulse width modulation in which the cycle is made constant and the ratio between the ON period and the OFF period of the transistor $Q_1$ (the duty ratio of the ON/OFF control pulse signal) is changed. The output voltage of the step down type increases in proportion with the rate of the ON time of the transistor $Q_1$. The output voltage of the transistor $Q_1$ increases in proportion to the square of the rate of the ON time of the transistor $Q_1$.

Figure 8:
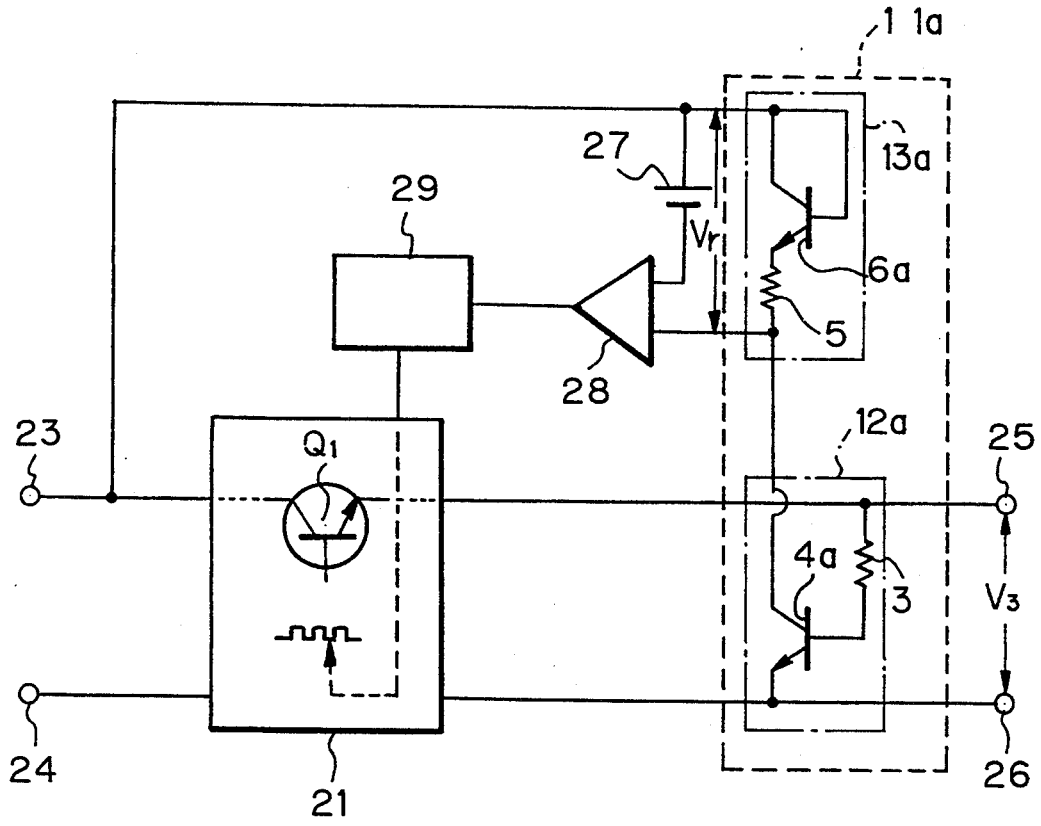
FIG. 8 is a circuit diagram of a voltage stabilizing circuit according to still another embodiment of the present invention.

FIG. 8 is a circuit diagram of a voltage stabilizing circuit applied to a switching power supply circuit, according to another embodiment of the present invention.

The only difference between FIG. 3 and FIG. 8 is that, instead of the PNP transistors 4 and 6 in FIG. 3, NPN transistors 4a and 6a are employed in a voltage detecting circuit 11a. The voltage detecting circuit 11a consists of a first circuit 12a and a second circuit 13a. The first circuit 12a includes the NPN transistor 4a and the resistor 3. The second circuit 13a includes the NPN transistor 6a and the resistor 5. The collector of the NPN transistor 4a is connected to an input of the comparator 28. The base of the NPN transistor 4a is connected through the resistor 3 to the output terminal 25. The emitter of the NPN transistor 4a is connected to the output terminal 26. The NPN transistor 6a is connected to function as a diode. Namely, the collector and the base of the NPN transistor 6a are connected together to the input terminal 23 of the switching power supply circuit 21. The emitter of the NPN transistor 6a is connected thorough the resistor 5 to the collector of the NPN transistor 4a.

By this construction, the same effect as that provided by the circuit in FIG. 3 can be obtained.

Figure 9:
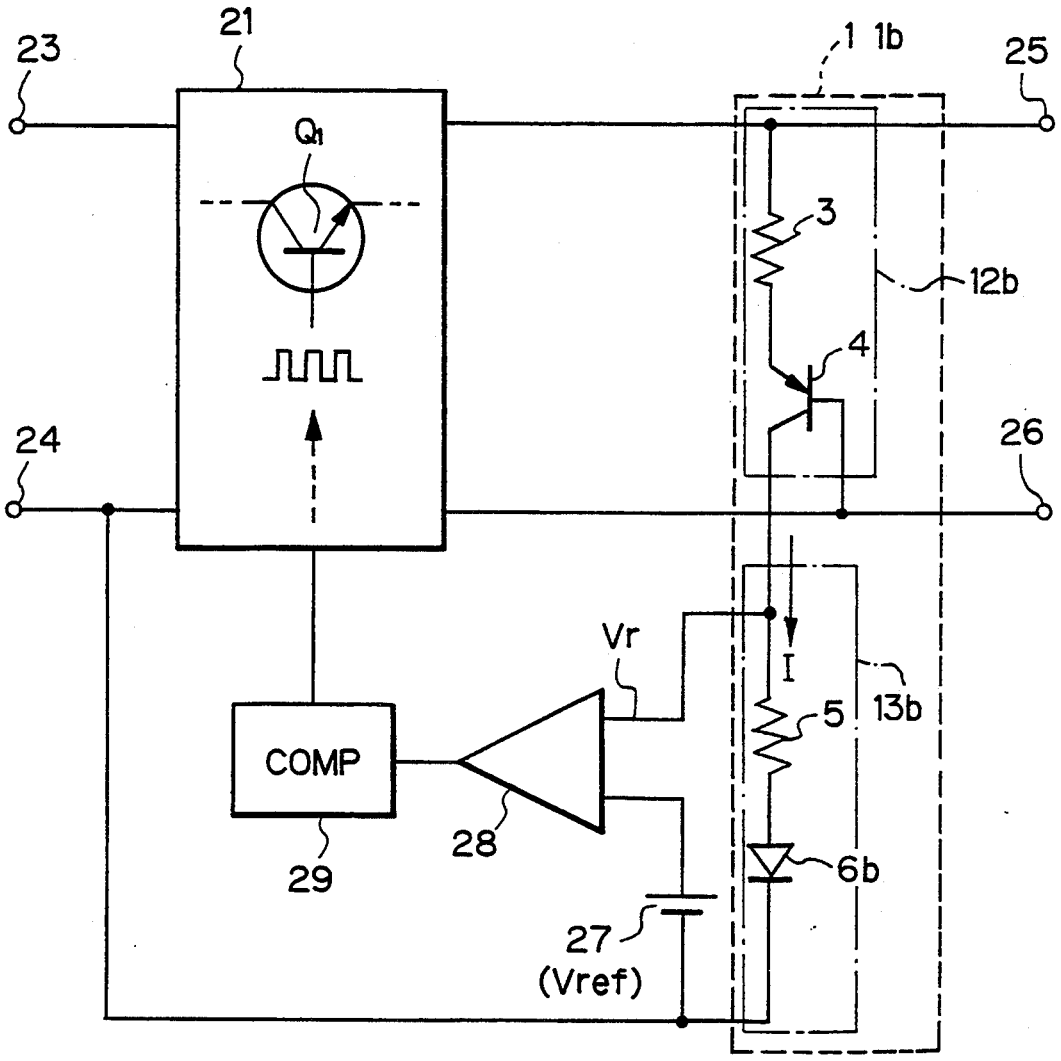
FIG. 9 is a circuit diagram of a voltage stabilizing circuit according to still another embodiment of the preset invention.

FIG. 9 is a circuit diagram of a voltage stabilizing circuit applied to a switching power supply circuit, according to still another embodiment of the present invention. The FIG. 9, a voltage detecting circuit 11b consists of a first series circuit 12b and a second series circuit 13b. The first series circuit 12b is the same as the first series circuit 12 in FIG. 3.

The only difference between FIG. 3 and FIG. 9 is that, instead of the PNP transistor 6 in FIG. 3, a diode 6b is employed in the second series circuit 13b. The anode of the diode 6b is connected through the resistor 5 to the collector of the PNP transistor 4. The cathode of the diode 6b is connected to the input terminal 24.

By this construction also, the same effect as that in FIG. 3 can be obtained.

Figure 10:
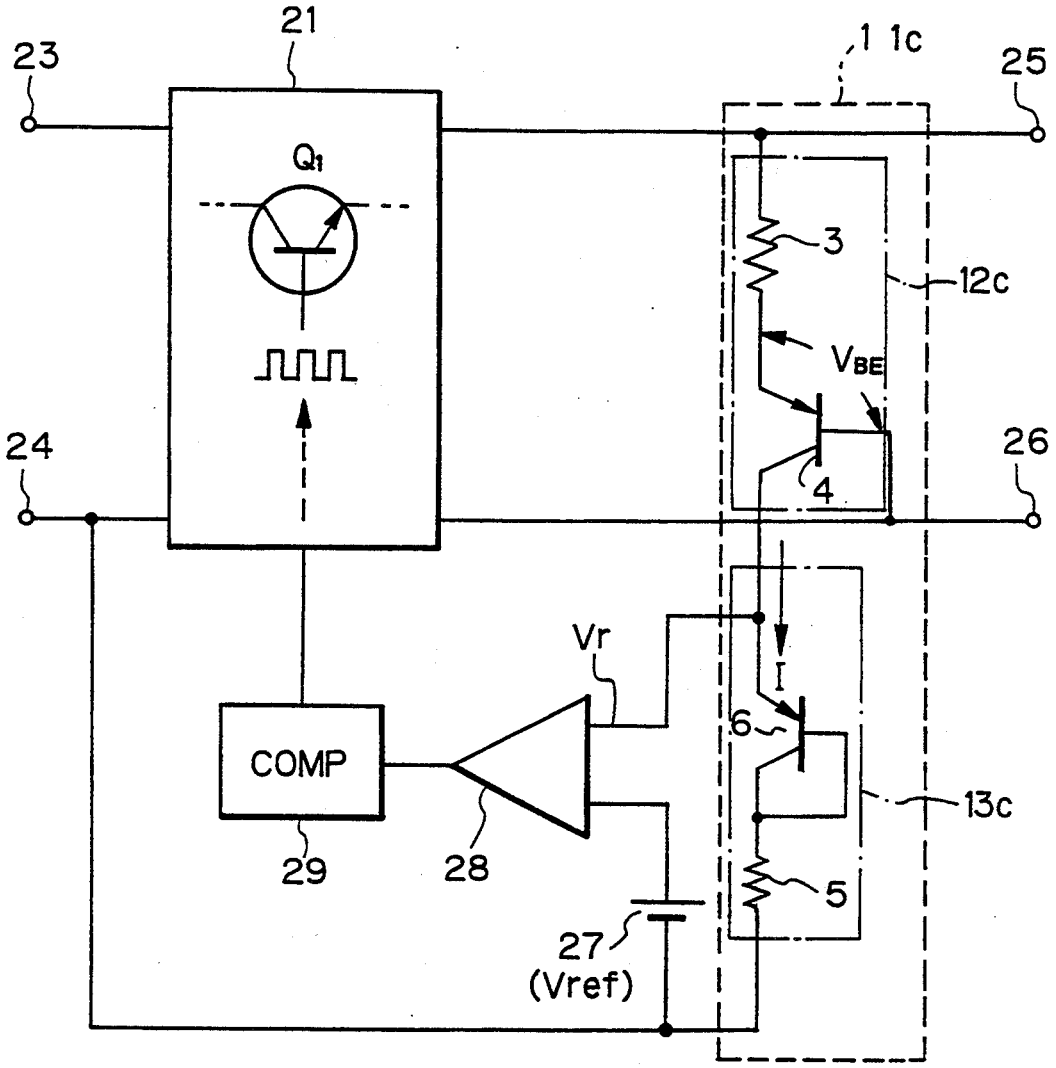
FIG. 10 is a circuit diagram of a voltage stabilizing circuit according to still another embodiment of the present invention.

FIG. 10 is a circuit diagram of a voltage stabilizing circuit according to still another embodiment of the present invention. In FIG. 10, a voltage detecting circuit 11c consists of a first series circuit 12c and a second series circuit 13c. The first series circuit 12c is the same as the first series circuit 12 in FIG. 3.

The only difference between FIG. 3 and FIG. 10 is that, in FIG. 10, the emitter of the PNP transistor 6 in the second series circuit 13c is directly connected to the collector of the PNP transistor 4, and the collector of the PNP transistor 6 is connected through the resistor 5 to the negative electrode of the battery 27. In the circuit of FIG. 10 also, the transistor 6 may be replaced by a diode.

By this construction also, the same effect as that provided by the circuit in FIG. 3 can be obtained.

From the foregoing description, it is apparent that, according to the present invention, the voltage stabilizing circuit has a construction in which the component of the base-emitter voltage $V_{BE}$ Of a transistor in the voltage detecting circuit can be omitted from the related equation between the output voltage to be stabilized and a control voltage for controlling the voltage stabilizing circuit. Therefore, even when the temperature fluctuates, fluctuation of the detected control voltage is not caused so that the accuracy of the output voltage can be increased. Further, in comparison with the conventional voltage stabilizing circuit using the mirror circuit, the number of resistors to be used can be decreased in the voltage detecting circuit of the present invention so that space efficiency when the circuit is mounted in various electronic devices can be improved or a cost decrease can be attained.

We claim:

1. A voltage stabilizing circuit for stabilizing an output voltage across output terminals of an electronic device, comprising:

a voltage detecting circuit, operatively connected to said output terminals of said electronic device, for detecting a control voltage in response to said output voltage; and a control circuit, operatively connected between said voltage detecting circuit and said electronic device, for stabilizing, based on said control voltage, said output voltage of said electronic device;

said voltage detecting circuit including:

a first series circuit consisting of a first resistor and a first transistor connected in series, said first transistor having a first electrode connected through said first resistor to one of said output terminals, a base electrode connected to another one of said output terminals, and a second electrode; and a second series circuit connected in series with said first series circuit and consisting of a second resistor and a second transistor connected in series, said second transistor being connected to function as a diode and having a third electrode connected through said second resistor to said second electrode of said first transistor; wherein said control voltage is generated across said second series circuit by said second resistor and second transistor thereof and said first resistor and said second resistor have substantially the same resistances so that said control voltage is made to be substantially the same as said output voltage.

2. A voltage stabilizing circuit as claimed in claim 1, wherein said first transistor and said second transistor are PNP transistors.

3. A voltage stabilizing circuit as claimed in claim 2, wherein said first electrode of said first transistor is an emitter, and said third electrode of said second transistor is an emitter, the emitter-base voltage of said first transistor being substantially the same as the emitter-base voltage of said second transistor.

4. A voltage stabilizing circuit as claimed in claim 1, wherein said electronic device is a switching power supply circuit, and said control circuit controls, in response to said control voltage, an ON and OFF period of an input voltage applied to said switching power supply circuit.

5. A voltage stabilizing circuit for stabilizing an output voltage across output terminals of an electronic device, comprising:

a voltage detecting circuit, operatively connected to said output terminals of said electronic device, for detecting a control voltage in response to said output voltage; and a control circuit, operatively connected between said voltage detecting circuit and said electronic device, for stabilizing, based on said control voltage, said output voltage of said electronic device;

said voltage detecting circuit including:

a first circuit consisting of a first resistor and a first transistor, said first transistor having a first electrode connected through said first resistor to one of said output terminals, a base electrode connected to another one of said output terminals, and a second electrode connected to an input of said control circuit; and a second circuit connected in series with said first circuit and consisting of a second resistor and a second transistor connected in series, said second transistor being connected to function as a diode and having a third electrode connected through said second resistor to said second electrode of said first transistor and having a fourth electrode connected to an input terminal of said electronic device; wherein said control voltage is obtained across said second circuit by said second resistor and said second transistor thereof and said first resistor and said second resistor have substantially the same resistances so that said control voltage is made to be substantially the same as said output voltage.

6. A voltage stabilizing circuit for stabilizing an output voltage across output terminals of an electronic device, comprising:

a voltage detecting circuit, operatively connected to said output terminals of said electronic device, for detecting a control voltage in response to said output voltage; and a control circuit, operatively connected between said voltage detecting circuit and said electronic device, for stabilizing, based on said control voltage, said output voltage of said electronic device;

said voltage detecting circuit including:

a first series circuit including a first resistor and a first transistor connected in series, said first transistor having a first electrode connected through said first resistor to one of said output terminals, a base electrode connected to another one of said output terminals, and a second electrode; and a second series circuit connected in series with said first series circuit and including a second resistor and a diode connected in series, said diode having an anode connected through said second resistor to said second electrode of said first transistor; wherein said control voltage is generated across said second series circuit and said first resistor and said second resistor have substantially the same resistances so that said control voltage is made to be substantially the same as said output voltage.

7. A voltage stabilizing circuit for stabilizing an output voltage across output terminals of an electronic device, comprising:

a voltage detecting circuit, operatively connected to said output terminals of said electronic device, for detecting a control voltage in response to said output voltage; and a control circuit, operatively connected between said voltage detecting circuit and said electronic device, for stabilizing, based on said control voltage, said output voltage of said electronic device;

said voltage detecting circuit including:

a first series circuit including a first resistor and a first transistor having a first electrode connected through said first resistor to one of said output terminals, a base electrode connected to another one of said output terminals, and a second electrode; and a second series circuit connected in series with said first series circuit and consisting of a second transistor and a second resistor connected in series, said second transistor being connected to function as a diode and having a third electrode connected to said second electrode of said first transistor, and a fourth electrode connected through said second resistor to an input terminal of said electronic device;

said control voltage being obtained across said second series circuit and said first resistor and said second resistor having substantially the same resistances so that said control voltage is made to be substantially the same as said output voltage.

* * * * *